US009053684B2

(12) United States Patent
Johnson

(10) Patent No.: US 9,053,684 B2
(45) Date of Patent: Jun. 9, 2015

(54) GUITAR NECK ADJUSTMENT

(71) Applicant: David Johnson, San Jose, CA (US)

(72) Inventor: David Johnson, San Jose, CA (US)

( * ) Notice: Subject to any disclaimer, the term of this patent is extended or adjusted under 35 U.S.C. 154(b) by 0 days.

(21) Appl. No.: 14/269,630

(22) Filed: May 5, 2014

(65) Prior Publication Data

US 2014/0331846 A1 Nov. 13, 2014

Related U.S. Application Data

(60) Provisional application No. 61/820,548, filed on May 7, 2013.

(51) Int. Cl.
*G10D 3/06* (2006.01)
*G10D 1/08* (2006.01)

(52) U.S. Cl.
CPC ... *G10D 3/06* (2013.01); *G10D 1/08* (2013.01)

(58) Field of Classification Search
CPC ..... G10D 3/06
See application file for complete search history.

(56) References Cited

U.S. PATENT DOCUMENTS

| | | | | |
|---|---|---|---|---|
| 1,912,106 | A * | 5/1933 | Turturro | 84/293 |
| 5,458,035 | A * | 10/1995 | Okamura | 84/293 |
| 6,884,932 | B2 * | 4/2005 | Wrona et al. | 84/291 |
| 2014/0331846 | A1 * | 11/2014 | Johnson | 84/293 |

OTHER PUBLICATIONS

Gotoh Side Adjuster, see http://www.g-gotoh.com/international/?btp_product=sat-1.

* cited by examiner

*Primary Examiner* — Robert W Horn
(74) *Attorney, Agent, or Firm* — Douglas L. Weller

(57) ABSTRACT

A truss rod adjustment device includes a truss rod gear assembly, an adjustment gear assembly and a base. The truss rod gear assembly includes an end shaped to fit in and engage a truss rod wrench socket attached to a neck of a guitar. The adjustment gear assembly includes an adjustment socket shaped to receive and engage a wrench. The base attaches to the neck of the guitar and holds the truss rod gear assembly in position to engage the truss rod wrench socket. The base also holds the adjustment gear assembly in position both to engage the truss rod assembly gear assembly and to position the adjustment socket to be accessible through a hole in a back of the guitar.

9 Claims, 4 Drawing Sheets

GUITAR NECK ADJUSTMENT

BACKGROUND

Guitars often have truss rods within their necks. A truss rod is an adjustable metal rod that goes down the inside center of the guitar neck. In many guitars the truss rod can be adjusted using a nut located at one end of the truss rod. This allows adjustment of the shape of the neck. This adjustment can be very handy, for example, when temperature or humidity changes, etc., can tend to warp or otherwise change the shape of the neck. An adjustment of the trust rod can allow the neck to be maintained at an optimal shape for playing the guitar.

DESCRIPTION OF THE EMBODIMENT

Figure 1:
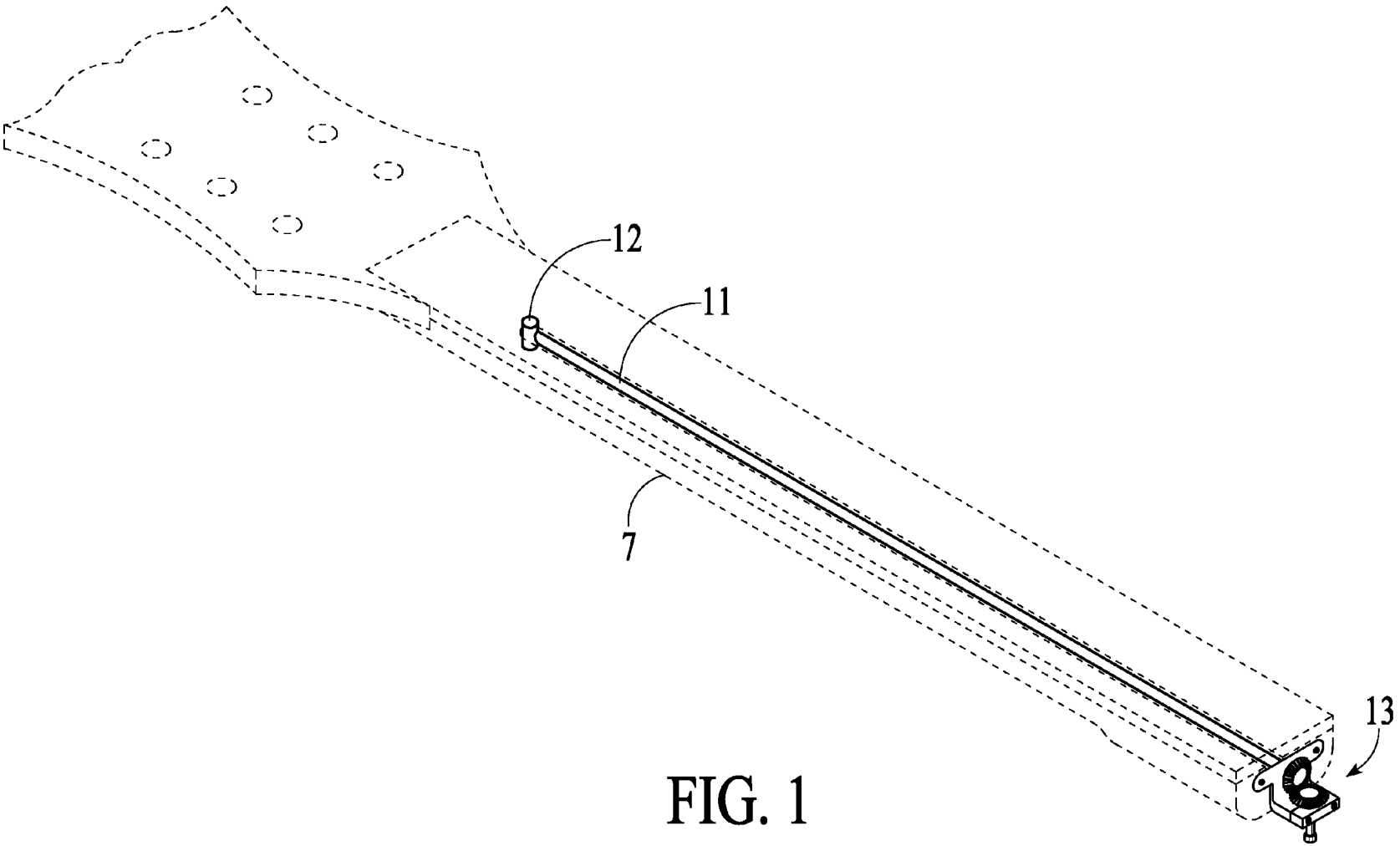
FIG. 1 shows a guitar neck with a truss rod and truss rod adjustment device in accordance with an embodiment.

FIG. 1 shows a truss rod 11 within a guitar neck 7. A truss rod adjustment device 13 is attached at a base of guitar neck 7. The base of guitar neck 7 is located within a bottom region of guitar neck 7 where guitar neck 7 is attached to a guitar body. A threaded anchor 12 anchors a threaded end of truss rod 11 within guitar neck 7. The threaded end of truss rod is screwed through threaded anchor 12 so that position of truss rod 11 with respect to threaded anchor 12 is adjusted by rotating truss rod 11 within guitar neck 7 and thus screwing rotating truss rod 11 through threaded anchor 12.

Figure 2:
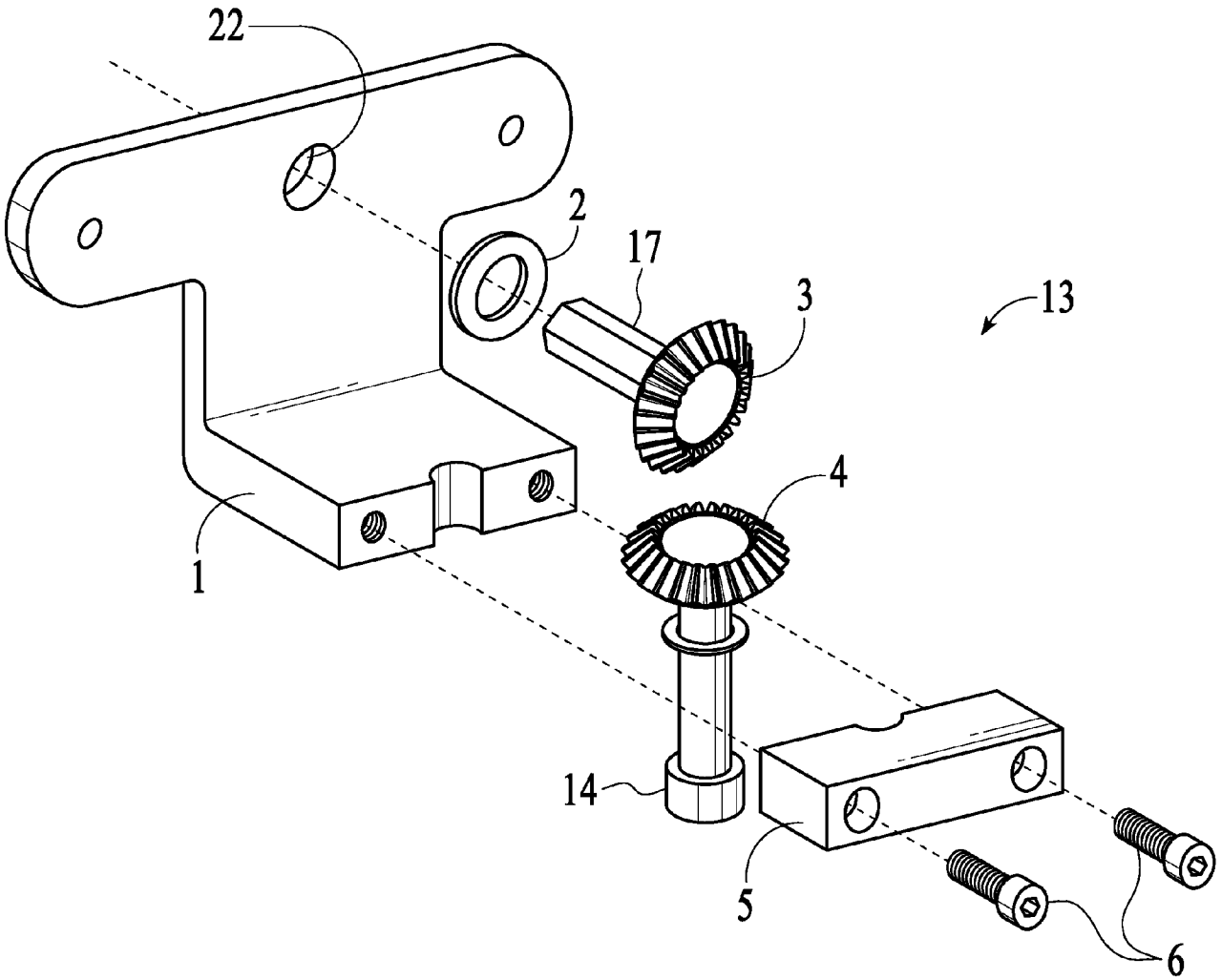
FIG. 2 shows details of the truss rod adjustment device in accordance with an embodiment.

FIG. 2 shows truss rod adjustment device 13 includes a base 1, a spring washer 2, a truss rod gear assembly 3, an adjustment gear assembly 4, a gear shaft collar 5 and collar screws 6, arranged as shown. To assemble, spring washer 2 is slid over truss rod gear assembly 3. Truss rod gear assembly 3 is then placed in hole 22 of base 1. Adjustment gear assembly 4 is slid into place so that the gears of truss rod gear assembly 3 and adjustment gear assembly 4 mesh. Gear shaft collar 5 is then secured to base 1 using collar screws 6. For example, truss rod gear assembly 3 and adjustment gear assembly 4 are made of metal or any material rigid enough to act as part of a gear assembly. Base 1, and gear shaft collar 5 can be made of any suitable material such as plastic, wood, or metal.

Figure 3:
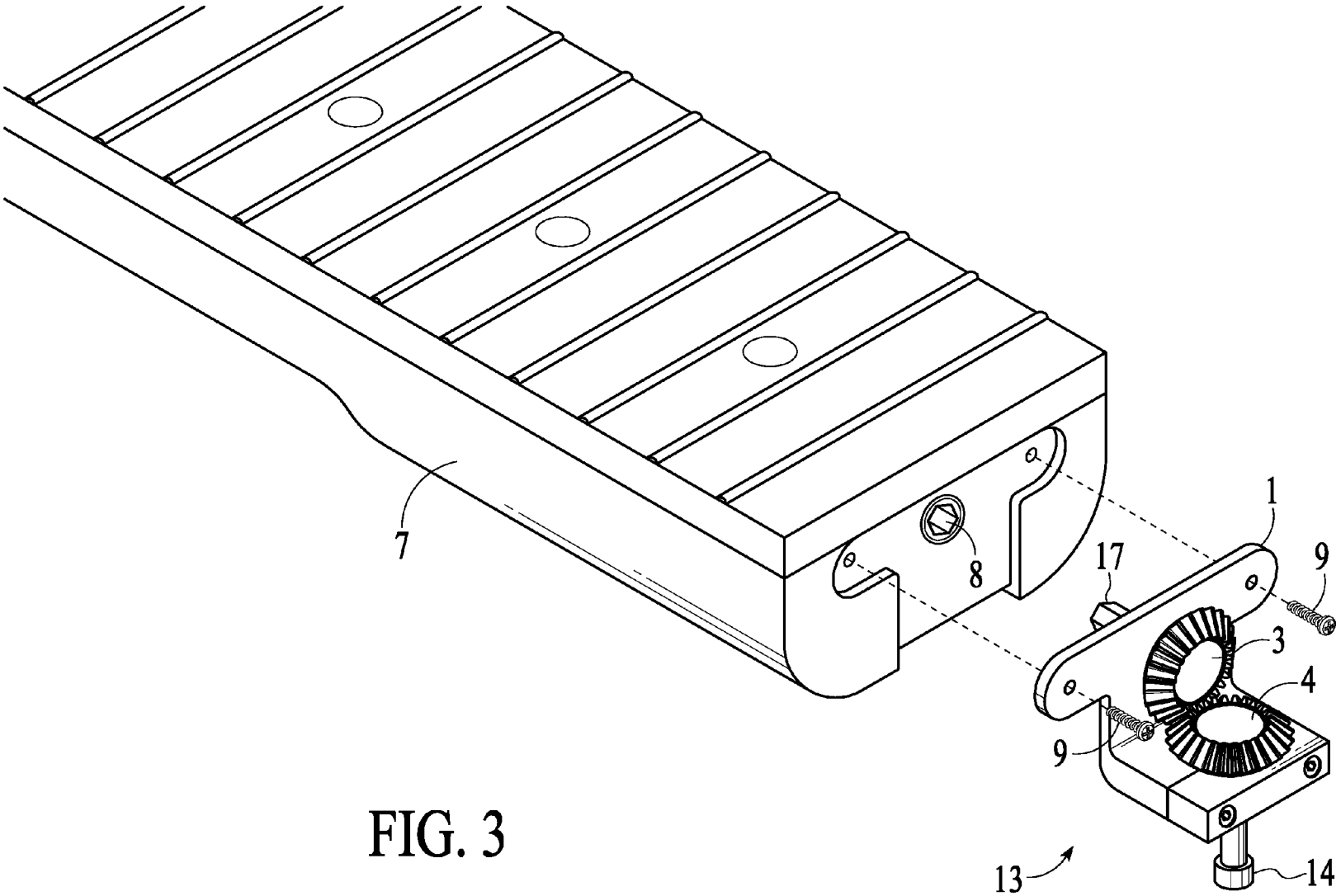
FIG. 3 shows the truss rod adjustment device ready to be attached to a guitar neck and inserted into a truss rod wrench socket in accordance with an embodiment.

FIG. 3 shows truss rod adjustment device 13 ready to be attached to guitar neck 7. To assemble, an end 17 of truss rod gear assembly 3 is placed with a truss rod wrench socket 8. End 17 of truss rod gear assembly 3 is shaped to fit within and engage truss rod wrench socket 8. Truss rod wrench socket 8 is a socket that is used to adjust tension of truss rod 11. Truss rod 11 is anchored at the location of truss rod wrench socket 8 so that inserting, for example, an Allen wrench into truss rod wrench socket 8 and rotating results in truss rod 11 turning within threaded anchor 12. Depending upon the rotational direction, the rotation results in tension across truss rod 11 either increases or decreases, and the distance between threaded anchor 12 and truss rod wrench socket 8 either decreases or increases, respectively. Adjusting the tension of truss rod 11 in this way allows for adjusting the shape of guitar neck 7. Alternative to being a socket that fits an Allen wrench, truss rod wrench socket 8 may have another shaped that allows engagement between truss rod wrench socket 8 and end 17 of truss rod gear assembly 3.

Truss rod adjustment device 13 is fixed to guitar neck 7 using, for example, wood screws 9 or some other fastening mechanism. Truss rod gear assembly 3 is inserted into truss rod wrench socket 8. In this position, truss rod gear assembly 3 engages truss rod wrench socket 8 making it possible to rotate truss rod 11 using truss rod adjustment device 13.

Figure 4:
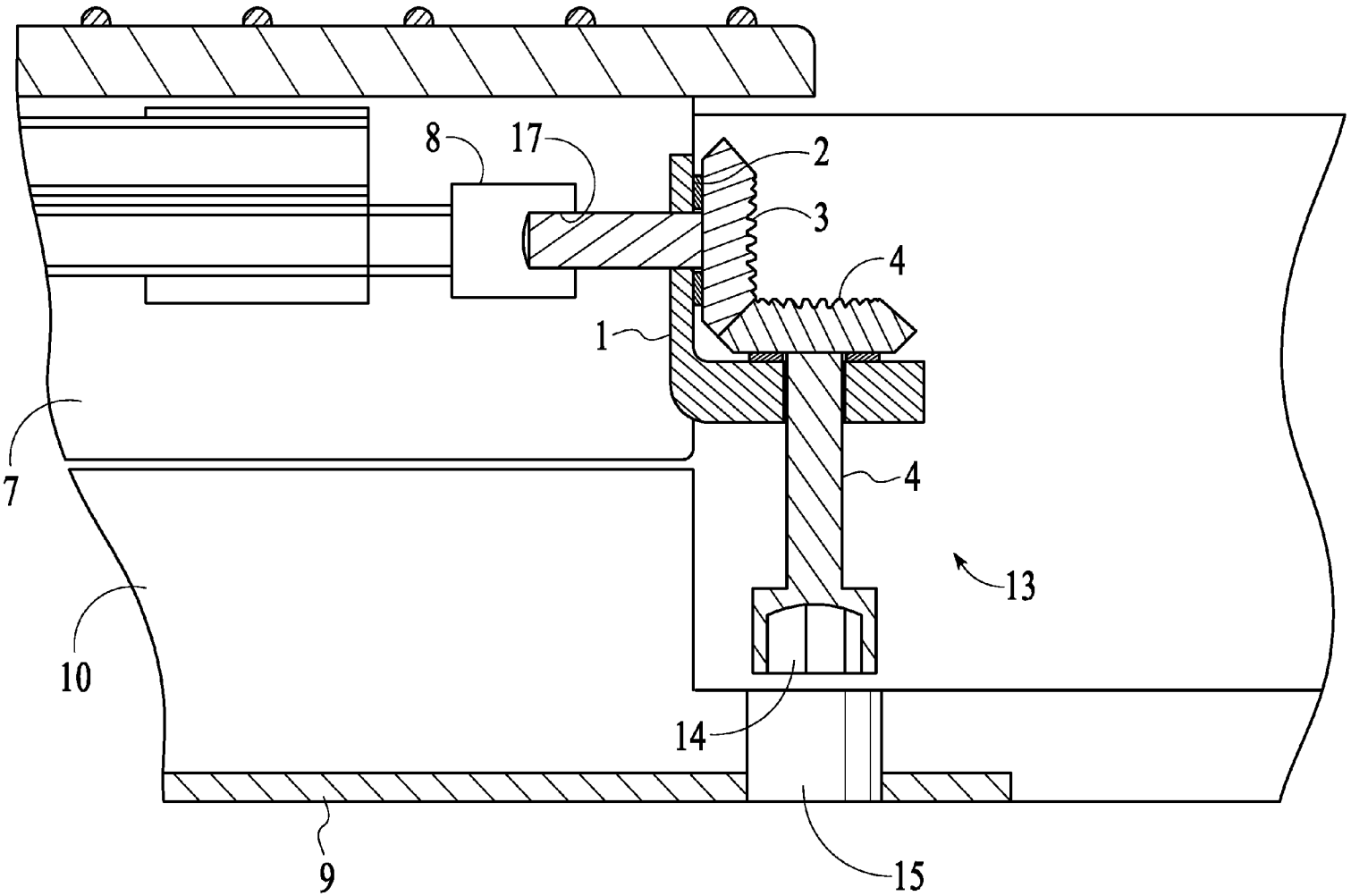
FIG. 4 sows a cutaway view of the truss rod adjustment device mounted within a guitar in accordance with an embodiment.

FIG. 4 sows a cutaway view of truss rod adjustment device 13 in place between guitar neck 7 and a guitar body 10. Neck mounting plate 9 is used to mount guitar neck 7 to guitar body 10.

Once in place, truss rod adjustment device 13 can be used to adjust tension of truss rod 11. For example, an Allen wrench can be inserted through a hole 15 in neck mounting plate 9 in order to engage an Allen socket receptacle 14 within adjustment gear assembly 4. Turning the engaged Allen wrench will result in turning of adjustment gear assembly 4, and thus turning of truss rod gear assembly 3. Since truss rod gear assembly 3 is inserted within truss rod wrench socket 8, turning the engaged Allen wrench will result in adjusting tension of truss rod 11. For example, to add "back bow" to guitar neck, the engaged Allen wrench is turned in a clockwise direction at quarter turn intervals. For example, to add "up bow" to guitar neck, the engaged Allen wrench is turned in a counter-clockwise direction at quarter turn intervals.

Alternative to being a socket that fits an Allen wrench, socket receptacle 14 within adjustment gear assembly 4 may have another shaped that allows engagement between socket receptacle 14 within adjustment gear assembly 4 and another type of wrench.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. A truss rod adjustment device comprising:

a truss rod gear assembly including an end shaped to fit in and engage a truss rod wrench socket attached to a neck of a guitar;

an adjustment gear assembly that includes an adjustment socket shaped to receive and engage a wrench; and, a base that attaches to a base of the neck of the guitar, that hold the truss rod gear assembly in position to engage the truss rod wrench socket and that holds the adjustment gear assembly in position both to engage the truss rod assembly gear assembly and to position the adjustment socket to be accessible through a hole in a back of the guitar.

2. A truss rod adjustment device as in claim 1 wherein the truss rod wrench socket is shaped to fit an Allen wrench.

3. A truss rod adjustment device as in claim 1 wherein the adjustment socket is shaped to fit an Allen wrench.

4. A guitar comprising:

a body;

a neck;

a truss rod located within the neck;

a trust rod wrench socket attached to the truss rod and located in a bottom region of the neck; and, a truss rod adjustment device, including:

a truss rod gear assembly including an end shaped to fit in and engage the truss rod wrench socket, an adjustment gear assembly that includes an adjustment socket shaped to receive and engage a wrench, and a base that attaches to the neck, that hold the truss rod gear assembly in position to engage the truss rod wrench socket and that holds the adjustment gear assembly in position both to engage the truss rod assembly gear assembly and to position the adjustment socket to be accessible through a hole in a back of the guitar body.

5. A guitar as in claim 4 wherein the truss rod wrench socket is shaped to fit an Allen wrench.

6. A guitar as in claim 4 wherein the adjustment socket is shaped to fit an Allen wrench.

7. A method for adjusting tension on a truss rod within a guitar neck, comprising:

attaching to a bottom region of the guitar neck a base that hold a truss rod gear assembly in position to engage a truss rod wrench socket attached to the truss rod and that holds an adjustment gear assembly in position both to engage the truss rod assembly gear assembly and to position an adjustment socket to be accessible through a hole in a back of a guitar body attached to the guitar neck;

inserting a wrench in the adjustment socket and rotating the wrench to adjust shape of the guitar neck.

8. A truss rod adjustment method as in claim 7 wherein the truss rod wrench socket is shaped to fit an Allen wrench.

9. A truss rod adjustment method as in claim 7 wherein the wrench is an Allen wrench.

* * * * *